US008349132B2

(12) United States Patent
Gregarek et al.

(10) Patent No.: US 8,349,132 B2
(45) Date of Patent: Jan. 8, 2013

(54) DEWATERING SCREEN AND METHOD FOR THE PRODUCTION THEREOF

(75) Inventors: Andre Gregarek, Munich (DE); Andreas Hanelt, Fischbachau (DE); Bernhard Wiedner, Miesbach (DE); Theodor Burchard, Gmund (DE); Andreas Aigner, Valley (DE); Gunther Wild, Hausham (DE)

(73) Assignee: Giesecke & Devrient GmbH, Munich (DE)

( * ) Notice: Subject to any disclaimer, the term of this patent is extended or adjusted under 35 U.S.C. 154(b) by 403 days.

(21) Appl. No.: 12/517,848

(22) PCT Filed: Dec. 5, 2007

(86) PCT No.: PCT/EP2007/010547

§ 371 (c)(1), (2), (4) Date: Jun. 8, 2010

(87) PCT Pub. No.: WO2008/071325

PCT Pub. Date: Jun. 19, 2008

(65) Prior Publication Data

US 2010/0175843 A1 Jul. 15, 2010

(30) Foreign Application Priority Data

Dec. 12, 2006 (DE) ..... 10 2006 058 513

(51) Int. Cl.
*B44F 1/12* (2006.01)

(52) U.S. Cl. ..... 162/140

(58) Field of Classification Search ..... 162/140, 162/903; 428/195, 292.1, 916
See application file for complete search history.

(56) References Cited

U.S. PATENT DOCUMENTS

| | | | | |
|---|---|---|---|---|
| 6,911,115 | B2 | 6/2005 | Mallol et al. | |
| 6,991,846 | B2 | 1/2006 | Mallol et al. | |
| 7,667,894 | B2 | 2/2010 | Hoffmuller | |
| 7,728,931 | B2 | 6/2010 | Hoffmuller | |
| 7,808,605 | B2 | 10/2010 | Hoffmuller | |
| 2001/0018113 | A1 * | 8/2001 | Mallol et al. | 428/195 |
| 2003/0056914 | A1 | 3/2003 | Mallol et al. | |
| 2007/0211238 | A1 | 9/2007 | Hoffmuller | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 | 3/2008 | Burchard | |

(Continued)

FOREIGN PATENT DOCUMENTS

DE 10064006 A1 7/2002

(Continued)

OTHER PUBLICATIONS

International Search Report, International Application No. PCT/EP2007/010547, 3 pages, Mar. 18, 2008.

(Continued)

*Primary Examiner* — Mark Halpern
(74) *Attorney, Agent, or Firm* — Greenlee Sullivan P.C.

(57) ABSTRACT

The present invention relates to a dewatering screen for manufacturing paper having multi-level watermarks, having a carrier mold (54) that exhibits, in a fractional region, a multi-level relief (30) in the form of the watermark to be produced. According to the present invention, it is provided that the multi-level relief is formed by an injection-molded, perforated (40) watermark insert (30).

24 Claims, 6 Drawing Sheets

U.S. PATENT DOCUMENTS

Figure 1:
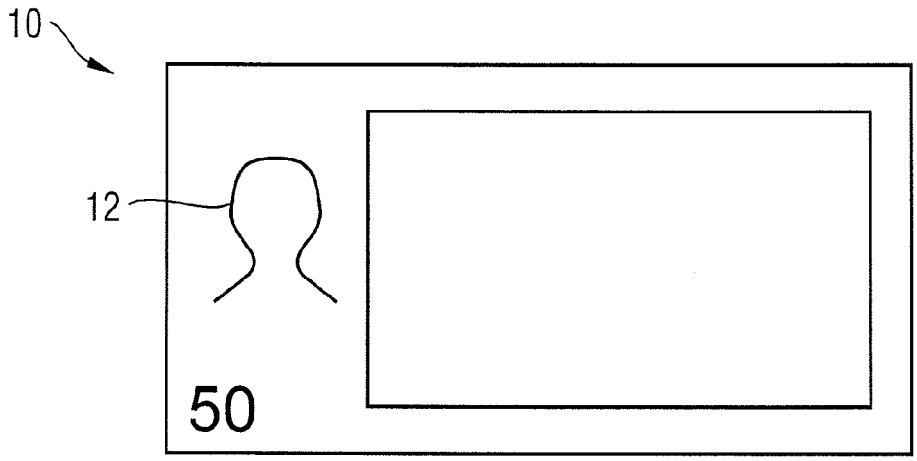

| | | | |
|---|---|---|---|
| 2008/0079257 | A1 | 4/2008 | Fessl |
| 2008/0088859 | A1 | 4/2008 | Depta |
| 2008/0160226 | A1 | 7/2008 | Kaule |
| 2008/0163994 | A1 | 7/2008 | Hoppe |
| 2008/0198468 | A1 | 8/2008 | Kaule |
| 2008/0216976 | A1 | 9/2008 | Ruck |
| 2008/0250954 | A1 | 10/2008 | Depta |
| 2008/0258456 | A1 | 10/2008 | Rahm |
| 2009/0001709 | A1 | 1/2009 | Kretschmar |
| 2009/0008923 | A1 | 1/2009 | Kaule |
| 2009/0008926 | A1 | 1/2009 | Depta |
| 2009/0102605 | A1 | 4/2009 | Kaule |
| 2009/0115185 | A1 | 5/2009 | Hoffmuller |
| 2009/0236061 | A1 | 9/2009 | Gruszczynski |
| 2009/0297805 | A1 | 12/2009 | Dichtl |
| 2009/0322071 | A1 | 12/2009 | Dichtl |
| 2010/0194091 | A1 | 8/2010 | Heim |
| 2010/0207376 | A1 | 8/2010 | Heim |

FOREIGN PATENT DOCUMENTS

| | | | |
|---|---|---|---|
| DE | 10064006 | A1 | 7/2002 |
| DE | 102006022059 | A1 | 12/2006 |
| EP | 1122360 | A1 | 8/2001 |
| WO | WO 03/025281 | A | 3/2003 |

OTHER PUBLICATIONS

International Preliminary Report on Patentability, International Application No. PCT/ EP2007/010547, 9 pages, Jun. 18, 2009, English Translation.

* cited by examiner

DEWATERING SCREEN AND METHOD FOR THE PRODUCTION THEREOF

CROSS-REFERENCE TO RELATED APPLICATIONS

This application is the U. S. National Stage of International Application No. PCT/EP2007/010547, filed Dec. 5, 2007, which claims the benefit of German Patent Application DE 10 2006 058 513.5, filed Dec. 12, 2006; both of which are hereby incorporated by reference to the extent not inconsistent with the disclosure herewith.

The present invention relates to a dewatering screen for manufacturing paper having multi-level watermarks, having a carrier mold that, in a fractional region, exhibits a multi-level relief in the form of the watermark to be produced. The present invention further relates to a method for manufacturing such a dewatering screen and a method for manufacturing a paper having a multi-level watermark using such a dewatering screen.

In manufacturing paper on cylinder mold machines or Fourdrinier machines, paper pulp continuously accretes on a moving dewatering screen and is solidified to the extent that it can be removed from the dewatering screen as a wet paper web for further processing. For protection, especially security papers for banknotes, identification documents and the like are often furnished with watermarks that permit the authenticity of the security paper to be verified, and that simultaneously serve as protection against unauthorized reproduction.

In manufacturing paper having watermarks, a distinction is made between two-level watermarks having a strong light-dark effect and multi-level watermarks having soft transitions between light and dark, and richly detailed depiction of a motif. Here, the term "multi-level" is to be understood as separate from two-level light-dark watermarks and comprises all watermarks having more than two brightness levels and especially also includes watermarks having continuous light-dark transitions.

To produce two-level watermarks, typically, metal wires or metal forming parts, so-called electrotypes, are soldered to the mold structure to completely close the dewatering screen at these locations. For the manufacture of multi-level watermarks, a three-dimensional relief is embossed in the dewatering screen such that the paper thickness of the finished paper varies according to the relief and permits, in transmitted light, soft, gradual transitions between lighter and darker regions to be perceived.

Based on that, the object of the present invention is to create a dewatering screen of the kind cited above that avoids the disadvantages of the background art. In particular, the dewatering screen is intended to facilitate the manufacture of paper having multi-level watermarks of highly precise detail and, wherever possible, can also be used on Fourdrinier or inclined wire paper machines.

This object is solved by the dewatering screen having the features of the independent claims. Methods for manufacturing dewatering screens, a watermark insert, an injection mold for manufacturing a watermark insert, a method for manufacturing a paper, a security paper and a value document having multi-level watermarks according to the present invention are specified in the coordinated claims. Developments of the present invention are the subject of the dependent claims.

According to a first aspect of the present invention, in a dewatering screen of the kind cited above, the multi-level relief is formed by an injection-molded, perforated watermark insert. Here, the inventive use of the injection molding method permits the production of multi-level watermark inserts having extraordinarily detailed relief depictions.

In a preferred variant of the present invention, the watermark insert is welded or bonded to the carrier mold. For this, the watermark insert can advantageously exhibit a knob edge at which it is joined with the carrier mold. In an alternative, likewise advantageous variant of the present invention, the watermark insert is injected directly into the carrier mold.

In both variants, the watermark insert can be disposed in a cut-out region of the carrier mold and joined therewith only in one edge region. The watermark insert can then especially be lowered such that the maximum height of the watermark insert corresponds substantially to the screen level.

The watermark insert is expediently formed from a hydrophobic plastic, for example from polyoxymethylene. To reduce wear in operation, wear-reducing additives can be added to the plastic. The additives are preferably optical fibers, glass spheres or carbon fibers.

The carrier mold advantageously exhibits a wire cloth having, in each case, at least one system of interwoven warp threads running lengthwise and weft threads running crosswise thereto. Here, the wire cloth can include a metal cloth, especially a bronze cloth, a metal-plastic blended cloth, especially a bronze-plastic blended cloth, or also a pure plastic cloth.

In both of the last-mentioned cases, as the plastic, the metal-plastic blended cloth or the plastic cloth preferably includes polyester, a high-temperature-resistant thermoplastic plastic from the group of polyetherketones, especially polyetheretherketone, or another higher-quality plastic. Polyethylene terephthalate (PET) is particularly preferably suitable. Here, the plastic of the watermark insert and the plastic of the wire cloth are advantageously coordinated with each other as regards their melting or glass transition temperatures. Thus, in certain embodiments, the melting or glass transition temperature of the wire cloth plastic can lie more than 40°, preferably more than 60°, particularly preferably more than 80° above the melting or glass transition temperature of the watermark insert plastic. In other embodiments, it can, in turn, be advantageous that the melting or glass transition temperatures of the plastics used are substantially identical.

To conceal or incorporate into the motif design the transition from the watermark insert to the carrier mold in the finished paper, the transition region of the watermark insert and the carrier mold is preferably designed in the form of a motif or a pattern. In particular, the edge of the watermark insert can be designed in the form of a motif or a pattern. Furthermore, the edge of the watermark insert can be formed such that there is no hard edge in the transition region, but rather a soft transition.

The watermark insert preferably exhibits, on its reverse, scores that facilitate a bending of the watermark insert in at least one direction. The scores thus have a kind of hinge effect. This has the advantage that the flexibility of the insert can be adapted to the flexibility of the mold. Particularly for cylinder molds or molds in Fourdrinier or inclined wire paper machines that are guided across rollers having rather tight radii, raised watermark inserts are suitable in their flexibility.

Further, the watermark insert preferably exhibits a plurality of perforations that ensure dewatering at paper manufacture. The dimensions of these dewatering perforations are chosen to be so small that no fibers stick in them at paper manufacture. The perforations preferably taper toward the watermark insert design area lying on top. The perforations can take on any form, such as points, asterisks, lines, etc. The dimensions of the perforations can also be chosen to be so large that they are visually perceptible as dark markings, preferably marking dots, in the finished paper. In this case, it is appropriate to dispose the perforations and thus the created markings in the form of characters, patterns or a code.

Within a watermark insert, different perforations can be present in different regions. The perforations can differ from region to region in the density of the hole grid and/or in the hole size. By means of the differently perforated regions, regions having differing brightness can be produced in the watermark. For example, the watermark becomes that much darker the narrower the hole grid is. A narrower hole grid leads to better dewatering and consequently to the accretion of more fibers. The watermark thus becomes darker.

The perforations are preferably produced by means of laser beam, especially by means of an infrared laser, such as a $CO_2$ laser. Here, the watermark insert is preferably impinged on from its reverse, facing away from the design area, with laser radiation such that perforations are created that taper toward the design area of the watermark insert. There can also be added to the plastic additives that facilitate the lasering of the perforation. For example, the additives can absorb the wavelength of the laser radiation particularly well.

The present invention also comprises a method for manufacturing a dewatering screen for manufacturing paper, in which a) a carrier mold is provided,
b) a separate watermark insert having a multi-level relief in the form of the watermark to be produced is manufactured in the injection molding method and perforated, and
c) the watermark insert is welded or bonded to the carrier mold.

According to a further inventive method for manufacturing a dewatering screen for manufacturing paper having multi-level watermarks, a) a carrier mold is provided,
b) a watermark insert having a multi-level relief in the form of the watermark to be produced is injected into the carrier mold in the injection molding method, and
c) the watermark insert integrated in the carrier mold is perforated.

Here, the wire cloth of the carrier mold is preferably squeezed into an injection molding die and sealed, and the plastic is then injected into the sealed injection molding die with the carrier mold. The wire cloth is expediently clamped in for the injection process to lessen the effects of different shrinkages in the cooling process. In this method variant, the carrier mold can also be perforated together with the watermark insert.

The hot-runner technique is preferably used as the injection molding method.

The present invention further includes a watermark insert for a dewatering screen of the kind described, the watermark insert constituting an injection-molded, perforated plastic insert having a multi-level relief in the form of the watermark to be produced.

The present invention also comprises an injection mold for manufacturing for a dewatering screen of the kind described a watermark insert that exhibits a multi-level relief in the form of the watermark to be produced.

In a second invention aspect, the present invention includes a dewatering screen of the kind cited above, in which the multi-level relief is formed by a deep-drawn, perforated watermark insert. According to yet a further aspect of the present invention, a dewatering screen of the kind cited above exhibits a multi-level relief that is formed by a hot-stamped, perforated watermark insert. In these two aspects of the present invention, the detailed embodiments of the watermark insert and the carrier mold and the joining of the two elements can occur similarly to the above-described manner, the distinctive features of the respective manufacturing method being accommodated accordingly.

In both additional aspects, first, a separate watermark insert having a multi-level relief in the form of the watermark to be produced can be manufactured in the deep-drawing method or in the hot-stamping method and perforated, and the separately manufactured watermark insert then joined with, especially welded or bonded to, the carrier mold.

Alternatively, in both aspects, a plastic flake can first be inserted in the carrier mold and, from the inserted plastic flake, a watermark insert having a multi-level relief in the form of the watermark to be produced manufactured in the deep-drawing method or in the hot-stamping method. In a subsequent method step, the watermark insert integrated in the carrier mold is perforated, if applicable together with the carrier mold. If a deep-drawing method is used, also an already pre-perforated plastic flake can be used such that the subsequent perforation step can be omitted.

The dewatering screens described can be cylinder molds or Fourdrinier or inclined wires.

Further, the present invention includes a method for manufacturing a paper, especially a security paper, having a multi-level watermark, in which the paper accretion occurs on one of the above-described dewatering screens having injection-molded, deep-drawn or hot-stamped watermark inserts.

Finally, the present invention also includes a security paper or value document, having a multi-level watermark, manufactured according to the inventive method. In particular, if the watermark is indeed very light and high-contrast, but the paper is very thin in the watermark region, it is appropriate to provide the security paper or the value document with a transparent, preferably stabilizing foil in the region of the multi-level watermark. For example, such a multi-level watermark can be disposed in the region of a cover foil of a banknote having a through opening, and stabilized by the cover foil. In a further embodiment, the foil can be provided with security elements, such as diffraction structures, liquid crystal layers, thin-layer structures, fluorescent substances, magnetic, conductive and/or metallic layers.

Further exemplary embodiments and advantages of the present invention are explained below by reference to the drawings, in which a depiction to scale and proportion was omitted in order to improve their clarity.

Figure 2A:
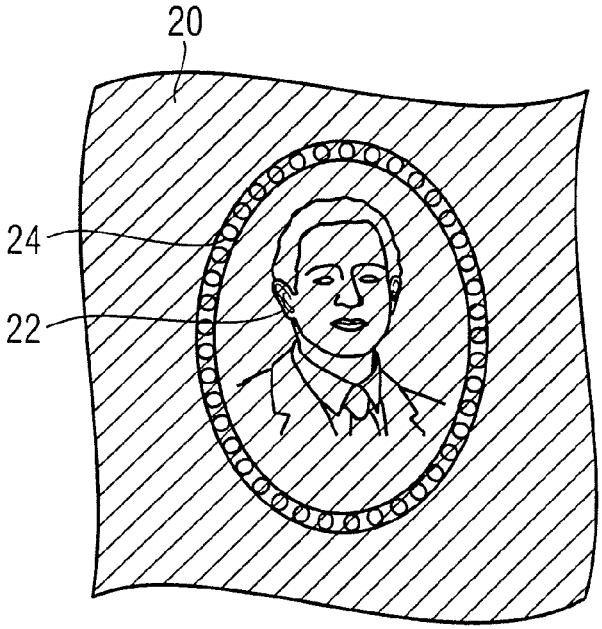
Figure 2B:
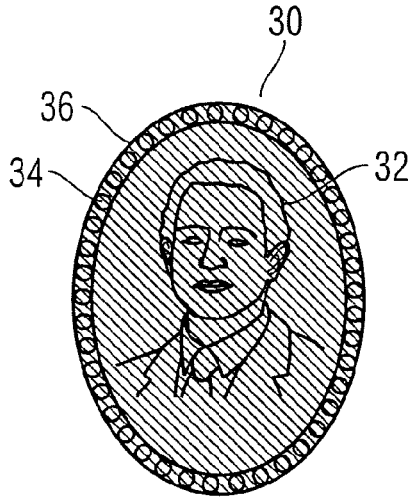
Figure 3A:
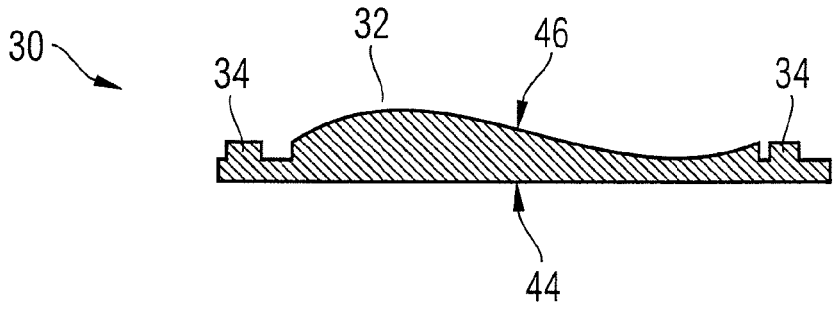
Figure 3B:
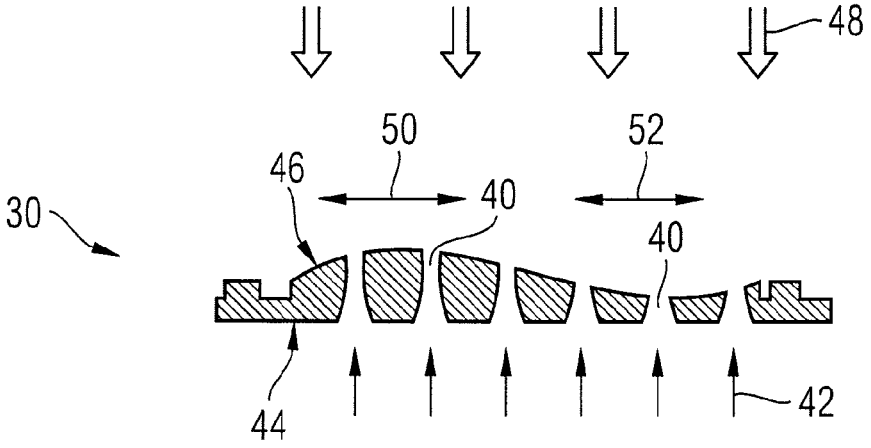
Figure 3C:
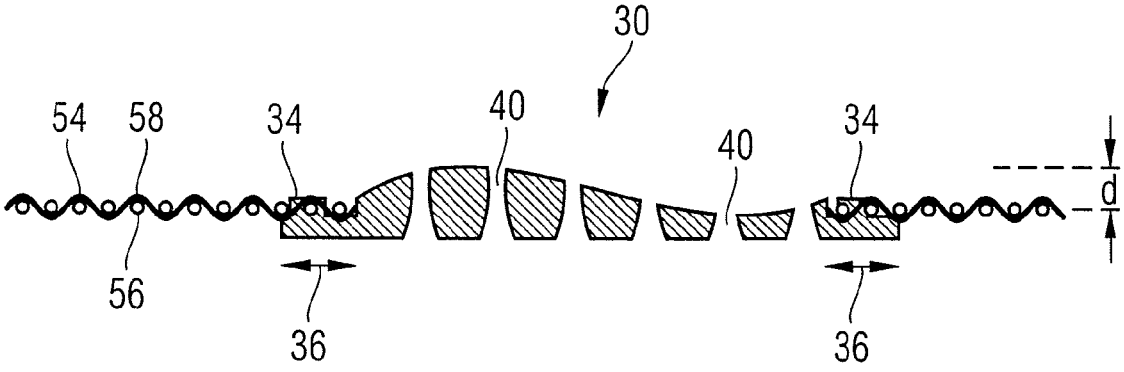
Figure 4A:
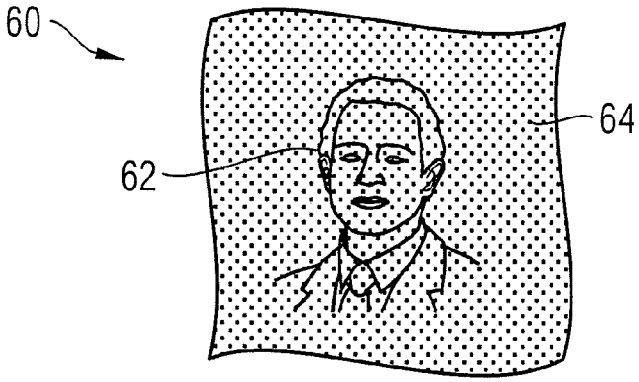
Figure 4B:
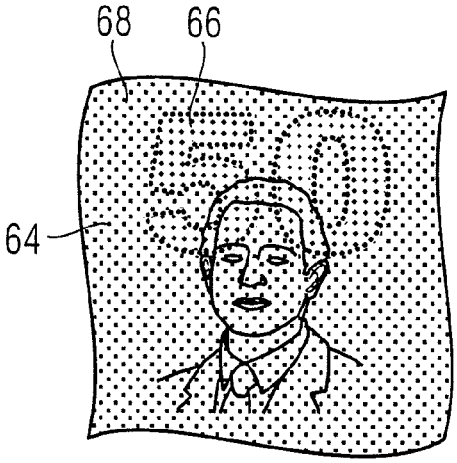
Figure 4C:
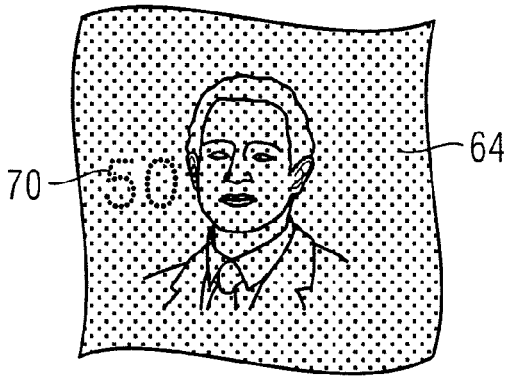
Figure 5:
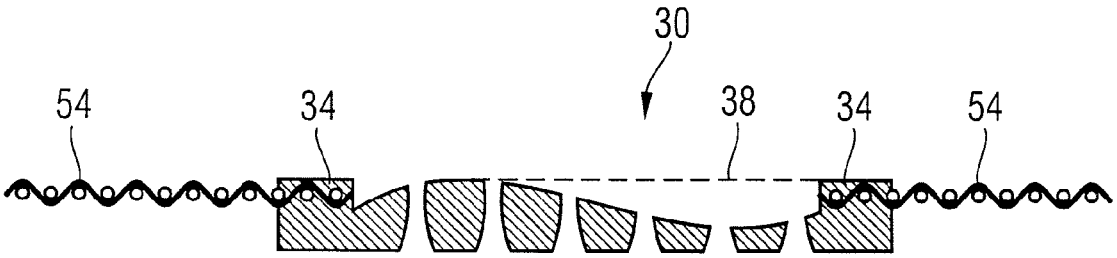
Figure 6A:
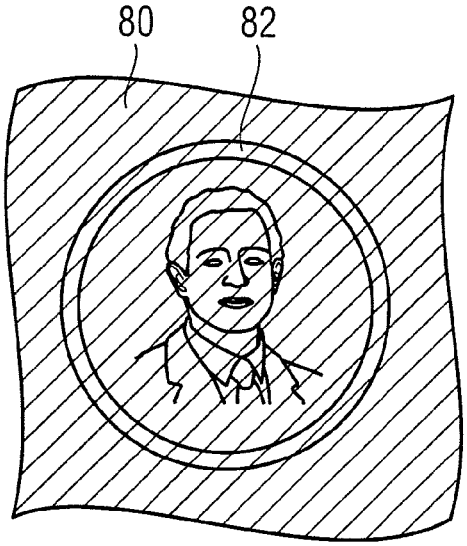
Figure 6B:
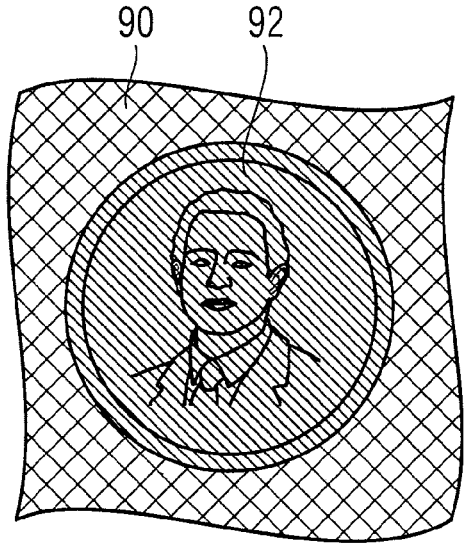
Figure 6C:
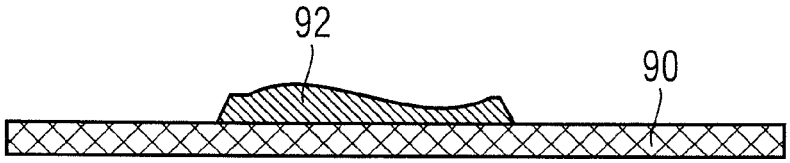
Figure 7:
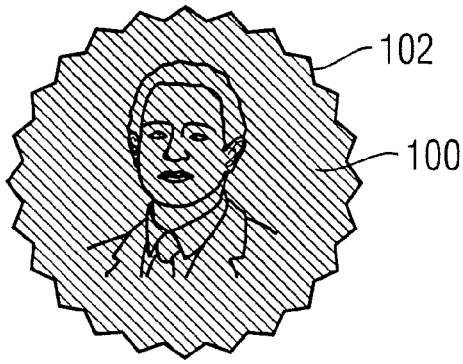
Figure 8A:
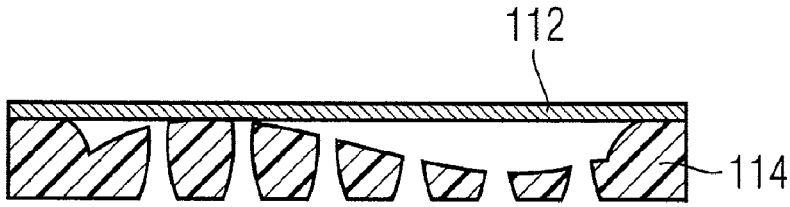
Figure 8B:
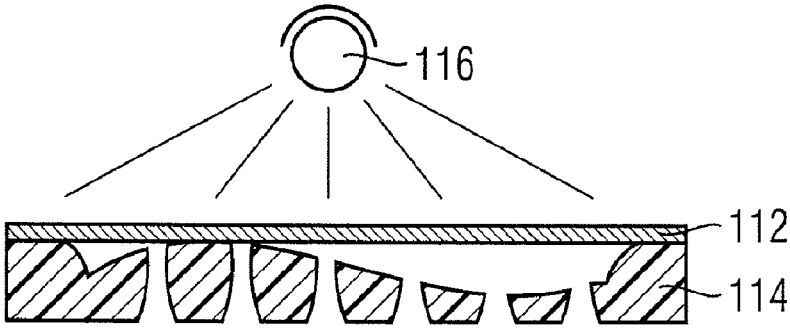
Figure 8C:
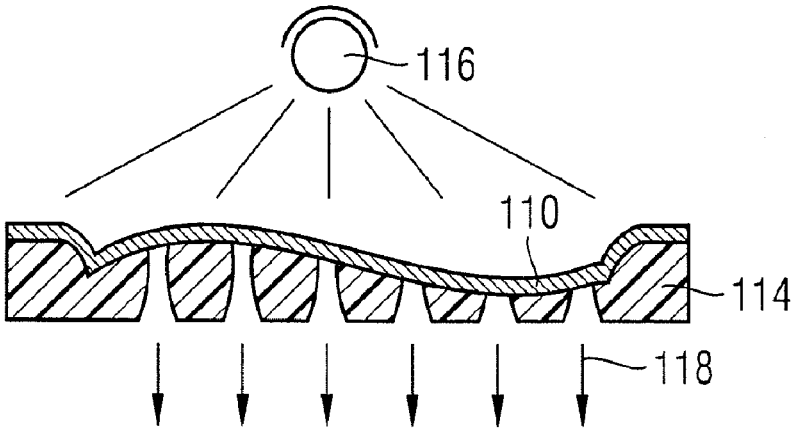
Figure 9A:
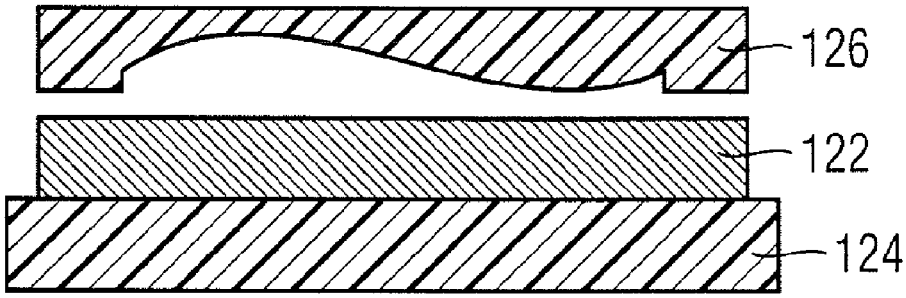
Figure 9B:
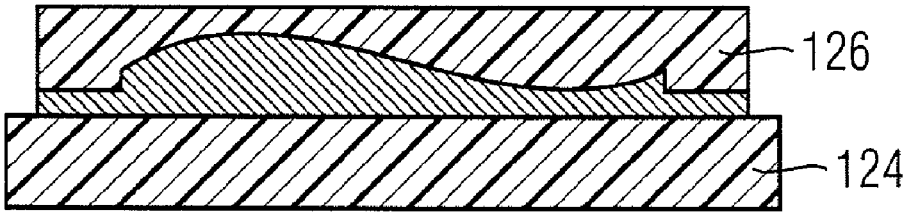
Figure 9C:
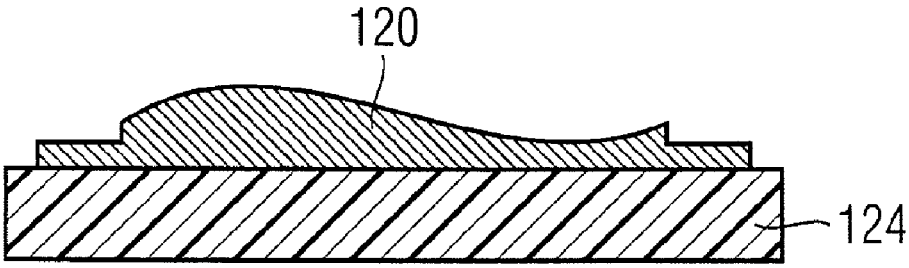

Shown are:

FIG. 1 a schematic diagram of a banknote having a multi-level watermark of high detail sharpness, FIG. 2 in (a), an injection mold for manufacturing a watermark insert, and in (b), an injection-molded watermark insert, as viewed from above, FIG. 3 in cross section: in (a), the watermark insert in FIG. 2(*b*), in (b), the watermark insert having laser-drilled perforations, and in (c), the perforated watermark insert joined with the wire cloth of a carrier mold, FIG. 4 in (a), a security paper having multi-level watermarks and having perforations that are visible as dark marking dots, the dark marking dots in (b) and (c) being designed as an additional security feature and/or as a perception feature, FIG. 5 a cross section through a dewatering screen in which, compared with the exemplary embodiment in FIG. 3(*c*), the watermark insert is lowered so far that its maximum height corresponds to the mold level, FIG. 6 in (a), a specially adapted injection mold for the direct injection of a watermark insert into the carrier mold, in (b), the carrier mold having a directly injected watermark insert, as viewed from above, and in (c), a carrier mold and insert, in cross section, FIG. 7 a watermark insert having an edge artistically designed in the form of a pattern, FIG. 8 in (a) to (c), three intermediate steps in the manufacture of a watermark insert by means of deep drawing, and FIG. 9 in (a) to (c), three intermediate steps in the manufacture of a watermark insert by means of hot stamping.

The invention will be explained below using a banknote as an example. For this, FIG. 1 shows a schematic diagram of a banknote 10 that includes a multi-level watermark 12 of high detail sharpness in the shape of a portrait that is only hinted at in FIG. 1. According to the present invention, the manufacture of banknotes having such sharply detailed, multi-level watermarks occurs using one of the below-described dewatering screens having injection-molded watermark inserts.

In a first variant of the present invention, described with reference to FIGS. 2 to 5, first, separate watermark inserts are manufactured in the injection molding method and perforated. The finished watermark inserts are then joined with, for example welded or bonded to, the carrier mold.

For this, FIG. 2(*a*) shows an injection mold 20 for manufacturing a watermark insert 30 that exhibits a multi-level relief 22 in the inverted form of the watermark to be produced. An injection-mold-suitable, hydrophobic plastic, for example polyoxymethylene with wear-reducing additives, is melted, pressed into the injection mold 20 with high pressure, and thereafter, cooled again. The created watermark insert 30, which is depicted in FIG. 2(*b*) as viewed from above and in FIG. 3(*a*) in cross section, shows a highly detailed impression 32 of the image motif 22 that is predetermined by the injection mold 20.

For the fixation of the watermark insert 30 to the carrier mold, in the injection mold 20 is provided an edge composed of knob-shaped indentations 24 that form, in the finished watermark insert 30, a circumferential knob edge 36 having raised fixation knobs 34.

The injection molding method permits the production of extraordinarily detailed relief depictions 32 in the watermark inserts 30. Even if, in the figures, only the design area 46 having a shape is always shown, given the appropriate design of the injection mold 20, also the reverse can, of course, exhibit a shape such that, for example, a watermark insert having constant material strength is created.

For further explanation, in the cross sections in FIG. 3 and the subsequent figures, the detailed relief in each case is depicted only schematically by a curved line.

To ensure dewatering at paper manufacture, the injection-molded watermark insert 30 is provided, by means of laser radiation 42, with a plurality of perforations 40, as shown in FIG. 3(*b*). Here, the dimensions of the perforations are chosen to be so small that no fibers stick in them at paper manufacture.

In special embodiments, in regions having high local material strength, the perforation can at least partially be omitted such that, in these regions, in principle, only little or no dewatering occurs and thus only very few to no paper fibers accrete. Thus, in these regions, a two-level watermark or a hole is produced. In this case, the non-perforated regions having high material strength act like electrotypes. With such an insert, highly detailed watermarks can be combined with two-level watermarks.

The dewatering perforations are advantageously drilled with a laser beam 42, for example with the beam of a $CO_2$ laser of a wavelength of 10.6 μm. Here, the focus diameter of the laser corresponds to the desired maximum perforation diameter and measures, for example, 500 μm. The laser irradiation preferably occurs from the reverse 44 of the watermark insert 30 such that, due to the Gauss-shaped energy distribution or the beam shape of the laser beam, perforations 40 that taper toward the front-side design area 46 of the insert are created, as depicted in FIG. 3(*b*).

In the exemplary embodiment in FIG. 3, the diameter of the perforations on the reverse 44 of the watermark insert measures around 500 μm, their diameter at the design area 46 depends, due to the tapering of the perforations, on the local material strength of the insert. As evident from FIG. 3(*b*), the perforation diameter at the design area 46 is smaller in regions of great material strength 50 than in regions of low material strength 52. For example, the perforation diameters at the design area 46 lie between 150 μm for great material strength and 350 μm for low material strength.

The perforations 40 that taper toward the design area 46 offer two advantages compared with recti-areal perforations: For one, they create a freewheel in the flow direction 48 of the fiber suspension at paper manufacture and thus effectively prevent permanent clogging of the dewatering perforations 40.

For another, the regions of great material strength 50 serve to produce thin sites in the paper. Since the smaller perforation diameter in these regions hinders the dewatering more strongly than in the regions of low material strength 52, the thin site formation in the regions 50 is further supported by the tapering perforations 40.

The spacing of the perforations 40 depends on the desired dewatering effect and measures, for example, about 500 μm.

The perforation diameter can also be chosen to be so large that, after paper manufacture, they are, in addition to the watermark 62, perceptible in the paper 60 as dark marking dots 64, as shown in FIG. 4(*a*), albeit in exaggerated depiction for illustration. The hole diameter for producing dark marking dots preferably measures at least 300 μm.

These dark points 64 can serve as an additional security feature and/or as a perception feature for the manufacturing method used. The perforations 40 and thus the marking dots 64 can also be disposed in a predefined pattern. The perforations can, for example, as shown in FIG. 4(*b*), be disposed in a fractional region 66 in a square grid, in another fractional region 68 in a hexagonal grid, the fractional regions 66, 68 forming a motif, such as a superordinate pattern or a code. To increase counterfeit security, the perforations 40 and the created marking dots 64 can, themselves, also form a pattern 70, as depicted by way of example in FIG. 4(*c*).

Coming back to the explanation of the manufacturing process in FIG. 3, the watermark insert 30 is joined with the wire cloth 54 of a carrier mold after perforation. The wire cloth exhibits in each case at least one system of interwoven warp threads 56 running lengthwise and weft threads 58 running crosswise thereto. In the context of the present invention, the wire cloth can include a metal cloth, especially a bronze cloth, a metal-plastic blended cloth, especially a bronze-plastic blended cloth, or also a pure plastic cloth. For example, the wire cloth can be a blended cloth composite of weft (reference number 58) 1:1 bronze/polyester and warp (reference number 56) in bronze.

In the exemplary embodiment depicted in FIG. 3(*c*), the wire cloth 54 is cut out in the region of the watermark and overlaps the watermark insert 30 merely in the region of the knob edge 36. The joining of the watermark insert and the wire cloth can occur, for example, by ultrasonic welding, through which the knobs 34 in the overlapping region are firmly joined with the wire cloth 54.

To reduce the wear on the watermark insert 30 at paper manufacture, the watermark height d, which measures about 1.0 mm in the exemplary embodiment in FIG. 3(*c*), can be decreased. Here, as shown in FIG. 5, the watermark insert 30 can be lowered so far that its maximum height 38 precisely corresponds to the mold level. In addition to reduced wear on the watermark inserts, this lowering leads to watermarks that, at uniformly high contrast, exhibit a somewhat darker visual appearance compared with the design in FIG. 3(*c*).

Instead of first manufacturing the watermark inserts separately and subsequently joining them with the carrier mold, the inserts can also be injected directly into the carrier mold, as now explained with reference to FIG. 6.

For direct injection into the carrier mold, a specially adapted injection mold 80, depicted schematically in FIG. 6(*a*), is used in which, for the injection process, the wire cloth of the carrier mold 90 is squeezed in and sealed along a sealing edge 82. The liquid plastic then cannot leak out laterally at injection molding.

In this way is created, after the injection molding step, the carrier mold 90 having an integrated watermark insert 92, shown in FIG. 6(*b*) as viewed from above and in FIG. 6(*c*) in cross section. Here, too, the watermark insert 92 displays, due to the injection molding technique used, a highly detailed impression of the image motif that is predetermined by the injection mold 80.

In a further method step, the integrated watermark insert 92 is provided with dewatering perforations by means of laser beam, as described above. If a bronze mold is used as the carrier mold 90, then due to the perforation, the watermark insert 92 is, however, permeable only at the sites at which a perforation of the insert 92 coincides with an open site in the mold 90, since the bronze mold itself is not perforated by the $CO_2$ laser. It is understood that this limitation can be appropriately accounted for and thus compensated for in the choice of number, size and spacing of the perforations. Since, when cooling, the injected plastic shrinks substantially more severely than the bronze mold material, at injection molding, the carrier mold is advantageously clamped in to prevent any blistering in the carrier mold 90.

If, instead of a bronze mold, a plastic-metal blended cloth or a pure plastic wire cloth is used, then, given suitable laser parameters, both the watermark insert 92 and the carrier mold 90 can be perforated by the laser impingement. In this case, for the plastic of the wire cloth, a material is chosen that has a higher melting point than the injection molding material. For example, polyoxymethylene having a melting or glass transition temperature of 166° C. can be used as the injection molding material, and polyetheretherketone having a melting or glass transition temperature of 335° C. as the mold material. The use of a plastic mold or a plastic-metal blended cloth also improves the deformation behavior when cooling, since the moduli of elasticity of the plastics used are substantially closer together than the moduli of elasticity of the injection molding material and bronze.

Also in the watermark inserts injected directly into the carrier mold, certain regions can—as described in FIG. 3—be designed such that they act as electrotypes. For this, in the directly injected watermark insert is provided a region having particularly high material strength that is not perforated. With the aid of the method of direct injection, electrotypes can also be produced as a separate element.

A further design possibility that can be used in all mold variants consists in cutting out the carrier mold 90 in the watermark region such that it now extends only into a defined edge region in the watermark insert 92. Such a design reduces, on the one hand, any mold deformation due to differing cooling behavior of the insert and the mold material and offers, on the other hand, the advantage that the watermark insert 92 can be perforated in the watermark region by means of laser radiation, without having to consider the properties of the carrier mold.

In all described designs, the transition region of the watermark insert and the carrier mold is normally visible in the finished paper. It is thus appropriate to include this transition region in designing the motif of the watermark. For example, as shown in FIG. 7, in a watermark insert 100 that is separate or integrated in the carrier mold, the edge 102 and thus the transition region of the watermark insert and the carrier mold can be designed artistically in the form of a motif or a pattern.

According to further aspects of the present invention, the watermark inserts can be produced, instead of by injection molding, also by deep drawing (thermoforming) or by hot stamping, as briefly explained below with reference to FIGS. 8 and 9.

In manufacturing watermark inserts 110 according to the present invention by means of deep drawing, first, as shown in FIG. 8(*a*), a plastic plate 112 composed of a suitable plastic material is laid on a deep-drawing die 114. As shown in FIG. 8(*b*), the plastic plate 112 is then heated, for example, with a radiant heater 116, and the heated plastic plate is suctioned into the deep-drawing die 114 by a negative pressure 118, as depicted in FIG. 8(*c*).

In a further method step, the deep-drawn plastic plate is perforated and joined with a carrier mold, as described above. Alternatively, also an already perforated plastic plate 112 can be used for the deep-drawing step. In this case, in deep drawing, the perforated plastic plate is covered with a flexible, air-impermeable material to be able to produce a suitable negative pressure.

Even if, presently, the described method sequence is preferred, it is, in principle, possible, through deep drawing, to bring a plastic plate that is already joined with the carrier mold into the desired form of the watermark.

With reference to FIG. 9, at manufacture of watermark inserts 120 according to the present invention by means of hot stamping, a suitable plastic material 122 is displaced in an embossing die 124, 126 and pressed. Here, as shown in FIG. 9(*a*), the plastic material 122 is first laid into a hot-stamping mold that consists of a male die 124 and a female die 126.

In the exemplary embodiment shown, only the female die 126 exhibits a punch form, it is understood, however, that also the male die 124 can exhibit a form. In this way, in particular, a watermark insert 120 can be produced having a uniform material strength.

Coming back to the depiction in FIG. 9(*b*), the plastic material 122 is heated and embossed by the embossing die 124, 126. Here, also the embossing die 124, 126 itself should be heated. FIG. 9(*c*) shows the embossed watermark insert 120 after final forming.

In a further method step, the hot-stamped plastic plate is, as described above, perforated and joined with a carrier mold.

Also in hot stamping, it is, in principle, possible to bring a plastic material that is already joined with a carrier mold into the desired form.

The invention claimed is:

1. A dewatering screen for manufacturing paper comprising multi-level watermarks, comprising a carrier mold that, in a fractional region, comprises a multi-level relief in the form of the watermark, characterized in that the multi-level relief is formed by an injection-molded, perforated watermark insert.

2. The dewatering screen according to claim 1, characterized in that the watermark insert is injected directly into the carrier mold.

3. The dewatering screen according to claim 2, characterized in that the maximum height of the watermark insert corresponds substantially to the screen level.

4. The dewatering screen according to claim 1, characterized in that the watermark insert is formed from a hydrophobic plastic.

5. The dewatering screen according to claim 4, wherein the hydrophobic plastic comprises polyoxymethylene.

6. The dewatering screen according to claim 1, characterized in that the carrier mold comprises a wire cloth comprising at least one system of interwoven warp threads running lengthwise and weft threads running crosswise thereto.

7. The dewatering screen according to claim 6, characterized in that the wire cloth includes a metal cloth.

8. The dewatering screen according to claim 6, characterized in that the wire cloth includes a metal-plastic blended cloth.

9. The dewatering screen according to claim 8, characterized in that, the metal-plastic blended cloth includes polyester, polyetheretherketone, polyethylene terephthalate (PET) or another high-quality plastic.

10. The dewatering screen according to claim 8, wherein the metal-plastic blended cloth comprises a plastic having a first melting or glass transition temperature and wherein the watermark insert comprises a plastic having a second melting or glass transition temperature, and wherein the first melting or glass transition temperature is more than 40° C. higher than the second melting or glass transition temperature.

11. The dewatering screen according to claim 8, wherein the metal-plastic blended cloth comprises a plastic having a first melting or glass transition temperature, wherein the watermark insert comprises a plastic having a second melting or glass transition temperature, and wherein the first melting or glass transition temperature and the second melting or glass transition temperature are substantially equal.

12. The dewatering screen according to claim 6, characterized in that the wire cloth includes a pure plastic cloth.

13. The dewatering screen according to claim 12, wherein the pure plastic cloth comprises a plastic having a first melting or glass transition temperature, wherein the watermark insert comprises a plastic having a second melting or glass transition temperature, and wherein the first melting or glass transition temperature is more than 40° C. higher than the second melting or glass transition temperature.

14. The dewatering screen according to claim 12, wherein the pure plastic cloth comprises a plastic having a first melting or glass transition temperature, wherein the watermark insert comprises a plastic having a second melting or glass transition temperature, and wherein the first melting or glass transition temperature and the second melting or glass transition temperature are substantially equal.

15. The dewatering screen according to claim 12, wherein the plastic cloth includes polyester, polyetheretherketone, polyethylene terephthalate (PET) or another high-quality plastic.

16. The dewatering screen according to claim 1, characterized in that the watermark insert is welded or bonded to the carrier mold.

17. The dewatering screen according to claim 1, characterized in that the watermark insert comprises a knob edge at which it is joined with the carrier mold.

18. The dewatering screen according to claim 1, characterized in that the watermark insert is disposed in a cut-out region of the carrier mold and joined therewith only in one edge region.

19. The dewatering screen according to claim 1, characterized in that the watermark insert is formed from a plastic comprising wear-reducing additives.

20. The dewatering screen according to claim 1, characterized in that the transition region of the watermark insert and the carrier mold is designed in the form of a motif or a pattern.

21. The dewatering screen according to claim 1, characterized in that the watermark insert comprises a plurality of perforations whose dimensions are so small that no fibers stick in them at paper manufacture.

22. The dewatering screen according to claim 21, wherein the watermark insert has a front side and a rear side, the front side comprising a design area having the shape of the multi-level relief, and wherein the perforations taper toward the watermark design area on the front side.

23. The dewatering screen according to claim 21, characterized in that the perforations are visually perceptible as dark markings in the finished paper.

24. The dewatering screen according to claim 23, characterized in that the perforations are disposed in the form of characters, patterns or a code.

* * * * *